United States Patent [19]

Minoda et al.

[11] Patent Number: 4,732,531

[45] Date of Patent: Mar. 22, 1988

[54] AIR SEALED TURBINE BLADES

[75] Inventors: Mitsuhiro Minoda, Tokyo; Shigeo Inoue, Tama; Hiroshi Usui, Akigawa; Hiroyuki Nouse, Tokyo, all of Japan

[73] Assignee: National Aerospace Laboratory of Science and Technoloyg Agency, Tokyo, Japan

[21] Appl. No.: 941,067

[22] Filed: Dec. 12, 1986

[30] Foreign Application Priority Data

Aug. 11, 1986 [JP] Japan ..... 61-188332

[51] Int. Cl.[4] ..... F01D 11/00

[52] U.S. Cl. ..... 415/115; 415/170 R; 415/DIG. 1

[58] Field of Search ..... 415/110, 112, 115–117, 415/170 R, 172 A, 174, 175, 176, 178, DIG. 1

[56] References Cited

U.S. PATENT DOCUMENTS

| | | | |
|---|---|---|---|
| 2,685,429 | 8/1954 | Auyer | 415/116 |
| 3,029,011 | 4/1962 | Lewis | 415/116 |
| 3,365,172 | 1/1968 | McDonough et al. | 415/117 |
| 3,883,263 | 5/1975 | Mai | 415/116 |
| 4,161,318 | 7/1979 | Stuart et al. | 415/172 A X |
| 4,303,371 | 12/1981 | Eckert | 415/116 |
| 4,311,431 | 1/1982 | Barbeau | 415/172 A |
| 4,419,044 | 12/1983 | Barry et al. | 415/117 |
| 4,526,226 | 7/1985 | Hsia et al. | 415/116 X |

FOREIGN PATENT DOCUMENTS

| | | | |
|---|---|---|---|
| 1163559 | 9/1958 | France | 415/116 |
| 57-41407 | 3/1982 | Japan . | |
| 57-157002 | 9/1982 | Japan . | |

*Primary Examiner*—Robert E. Garrett
*Assistant Examiner*—Joseph M. Pitko
*Attorney, Agent, or Firm*—Finnegan, Henderson, Farabow, Garrett & Dunner

[57] ABSTRACT

A gas turbine has a casing forming a fluid passage through which a primary fluid flows, and a rotor blade disposed in the fluid passage with a clearance between distal ends of the rotor blades and the casing. The casing has a plurality of spaced blow holes extending circumferentially thereof for communicating an external secondary fluid chamber with the clearance, the blow holes being formed at an incline with respect to the wall of the casing in such a manner that a secondary fluid discharged from the blow holes is imparted with a flow component that opposes a flow of the primary fluid leaking from the clearance. The amount of the secondary fluid discharged from the blow holes and the discharge pressure are controlled to hydromechanically vary the resistance which the secondary fluid offers to the primary fluid leakage flow, thereby making it possible to mimimize the leakage flow.

3 Claims, 7 Drawing Figures

AIR SEALED TURBINE BLADES

BACKGROUND OF THE INVENTION

This invention relates to a turbomachine such as a turbine or compressor and finds use in raising the efficiency of such a turbmachine by minimizing a leakage flow from a clearance between the rotor blades and casing of the machine.

FIG. 1 is a sectional view of a gas turbine representing an example of the prior art, which is also set forth in the specification of Japanese Patent Application Laid-Open (KOKAI) No. 57-124005. The turbine, indicated by numeral 1, includes an outer casing 2, an inner casing 3, stator blades 5 and rotor blades 6 arranged in an annular flow passage 4 formed between the inner and output casings, and a casing 8 arranged at the end portion of the rotor blade 6 so as to form a clearance 7 at the end portion of the rotor blade in the radial direction.

Since the turbine inlet temperature is raised in order to improve thermal efficiency and obtain a higher specific output, it is essential that the rotor blades 6 and housing 8 be cooled. To cool the casing 8, a secondary fluid chamber 9 for a cooling fluid is formed radially outwardly of the casing 8. Such cooling enables the clearance 7 between the casing 8 and end portion of the rotor blades 6 to be held constant by suppressing the thermal expansion of these members. To further enhance the cooling effect, the aforementioned Japanese Patent Application Laid-Open No. 57-124005 discloses means for allowing the cooling fluid to flow into the clearance 7 from the secondary fluid chamber 9 through the casing 8. To achieve this, the casing 8 is provided with blow holes for discharging a secondary fluid having a component in the direction of the primary fluid flow, which is that traveling through the annular flow passage 4.

A problem encountered in the conventional arrangement is that the clearance 7 between the rotor blade 6 and casing 8 cannot be reduced to zero even if the cooling of these members is performed effectively, and there will always be a small gap in the form of the clearance 7 as long as the rotor blade 6 does not contact the casing 8. This means that some of the primary or main fluid which has entered the annular flow passage 4 flows from the clearance 7 directly to the downstream side and is not converted into rotational energy. The result is a decline in efficiency. In other words, the efficiency of a turbomachine such as the above-described turbine can be raised by sufficiently cooling the rotor blade-end casing 8 and the rotor blades 6, and by minimizing the leakage of the primary or main fluid from the clearance 7.

SUMMARY OF THE INVENTION

Accordingly, an object of the present invention is to provide a turbomachine in which the leakage of primary fluid from the aforementioned clearance can be minimized.

According to the present invention, the foregoing object is attained by providing a turbomachine comprising a casing forming a fluid passage through which a primary fluid flows, and rotor blades disposed in the fluid passage with a clearance between a distal end of the rotor blade and the casing. A secondary fluid chamber is provided radially outwardly of the casing. According to a characterizing feature of the invention, the casing has a plurality of spaced blow holes extending circumferentially thereof for communicating the secondary fluid chamber with the clearance, the blow holes being formed at an incline with respect to the wall of the casing in such a manner that a secondary fluid discharged from the blow holes is imparted with a flow component that opposes a flow of the primary fluid leaking from the clearance.

Thus, in the turbomachine of the invention, the leakage of primary fluid from the clearance between the rotor blade-end casing and the rotor blade is controlled by a hydromechanical effect without changing the clearance geometrically. The amount of the secondary fluid discharged from the blow holes and the discharge pressure are controlled to hydromechanically vary the resistance which the secondary fluid offers to the primary fluid leakage flow. The effect produced is the same as that which would be obtained by geometrically reducing the clearance to substantially zero.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
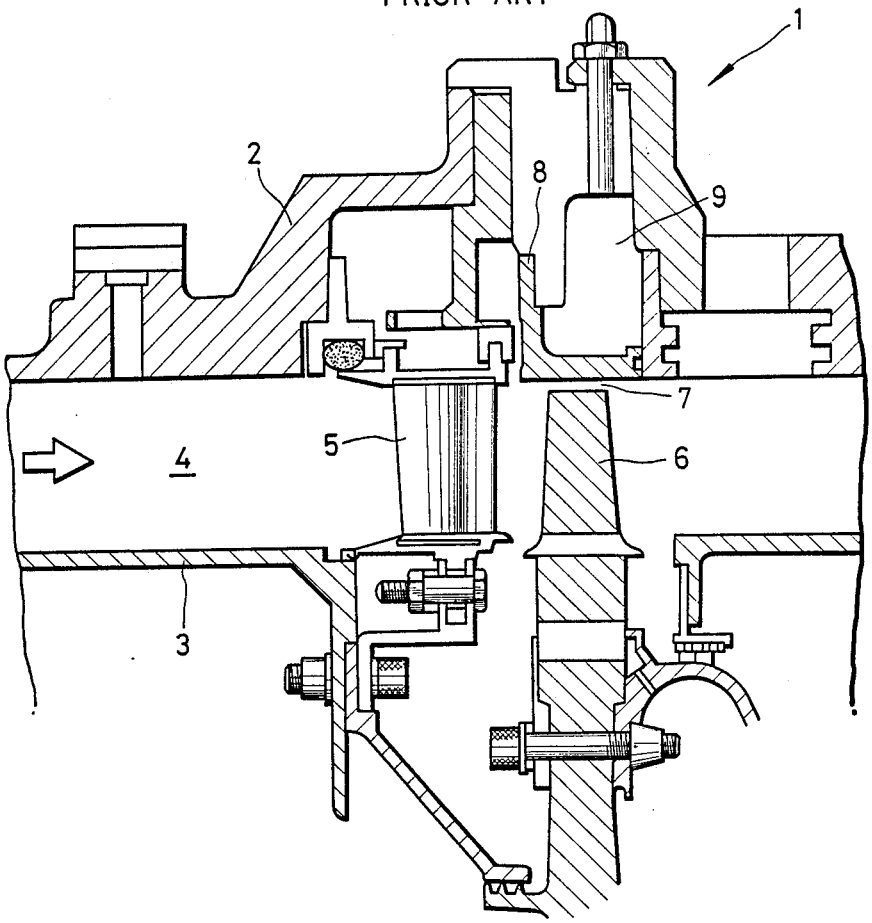
FIG. 1 PRIOR ART
FIG. 1 is a sectional view of a turbomachine according to the prior art.
Figure 2:
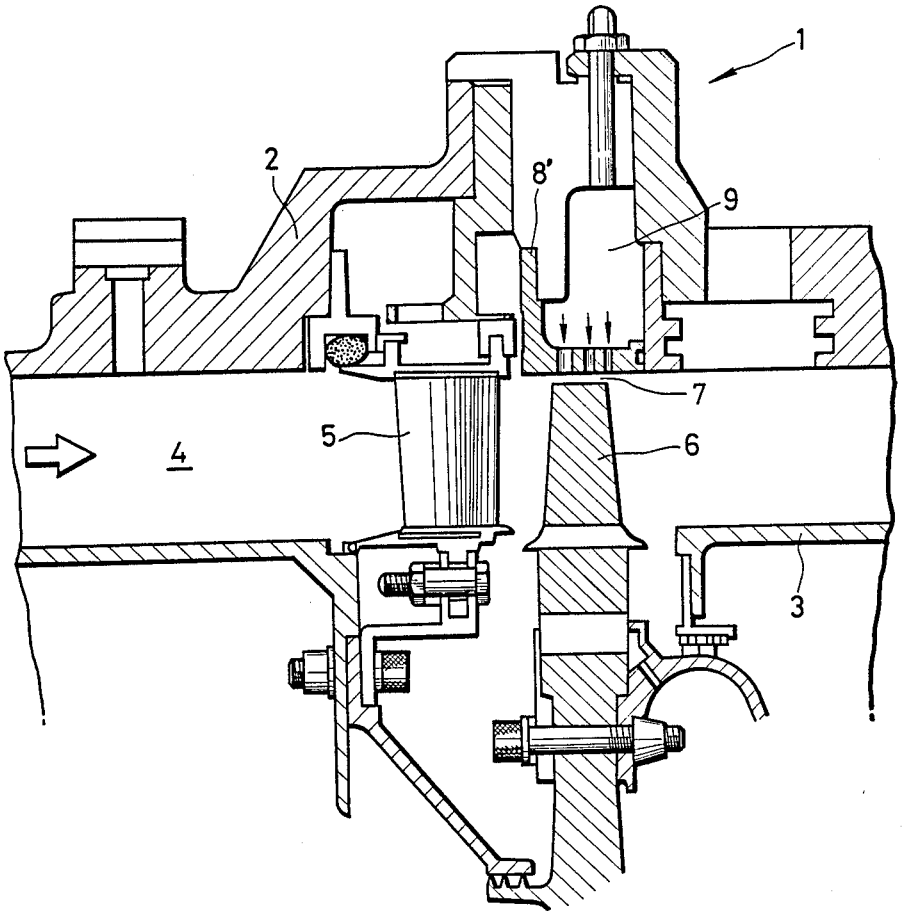
FIG. 2 is a sectional view of a turbomachine according to the present invention.

FIG. 2 is a sectional view of a gas turbine representing an embodiment of a turbomachine according to the present invention. The gas turbine, shown at numeral 1, includes the outer casing 2, the inner casing 3, the stator blades 5 and rotor blades 6 arranged in the annular flow passage 4 formed between the inner and output casings, and a casing 8' arranged at the end portion of the rotor blade 6 so as to form the clearance 7 at the end portion of the rotor blade in the radial direction. The secondary fluid chamber 9 into which the secondary fluid is introduced is formed on the outer side of the casing 8'.

Figure 4:
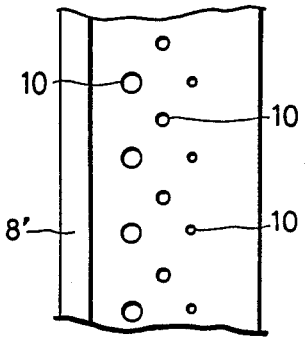
FIG. 4 is a plan view illustrating a portion of a casing and showing an arrangement of blow holes.
Figure 3:
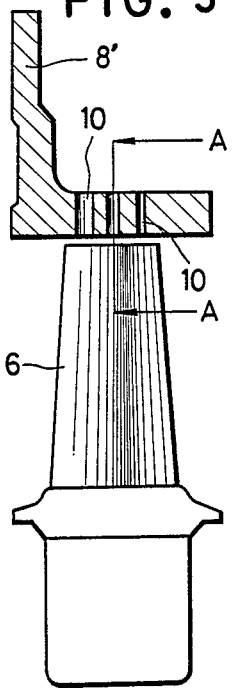
FIG. 3 is a view of rotor blades and rotor blade-end casing, the latter being shown in section.

The casing 8' is provided with blow holes 10 communicating the secondary fluid chamber 9 with the clearance 7. As shown in the sectional view of FIG. 3 and the plan view of FIG. 4, the blow holes 10 in the illustrated embodiment are arranged in staggered fashion in three axially spaced rows and are spaced equally circumferentially of the casing 8'. The diameters of the blow holes 10 in each row differ from those of the blow holes 10 in the other rows to freely regulate the amount of the secondary fluid discharged from the blow holes as well as the discharge pressure.

Figure 5:
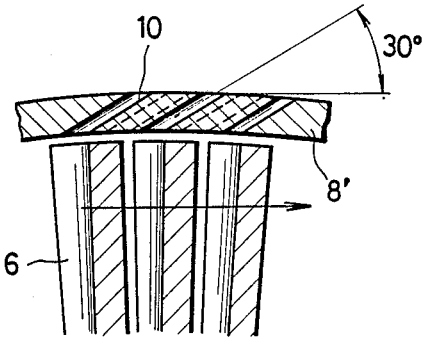
FIG. 5 is a sectional view taken along line A—A of FIG. 3.
Figure 6:
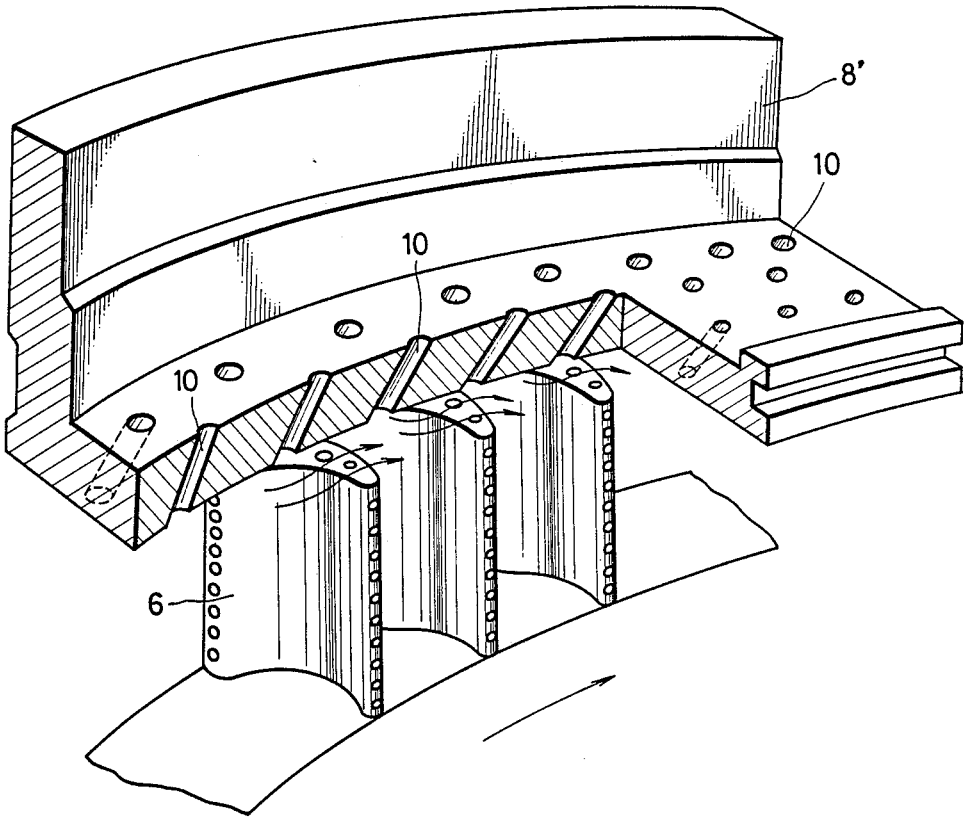
FIG. 6 is a perspective view, partially cut away, showing the rotor blades, housing and blow holes.

As illustrated in FIGS. 5 and 6, the blow holes 10 are inclined with respect to the wall of the casing 8' so as to impart the secondary fluid discharged from these holes with a component that opposes the leakage flow from the clearance 7, namely the leakage of the primary fluid fed into the annular flow passage 4. In the illustrated embodiment, the blow holes 10 are inclined at an angle of 30° with respect to the wall of the casing 8'.

In an experimental set-up using the gas turbine, the blow holes 10 were arranged to have diameters of 1.7 mm, 1.6 mm and 1.5 mm in respective ones of the three rows, starting from the upstream side, and each row was provided with an equal number (e.g. 150) of the blow holes 10 having identical spacing circumferentially of the casing 8'. The turbine had 66 stator blades and 114 rotor blades, with the clearance 7 between each rotor blade 6 and the casing 8' being 0.5 mm in the quiescent state. The turbine is as specified by the following table:

TABLE 1

| | |
|---|---|
| Inlet main fluid pressure | 235 KPa (2.4 Kg/cm$^2$, abs) |
| Inlet main fluid temperature | 410K (137° C.) |
| Total pressure-expansion ratio | 1.92 |
| Main fluid flow rate | 6.5 Kg/s |
| Rotational speed | 7300 rpm |
| Secondary fluid (air) | |
| Pressure | 245 KPa (2.5 Kg/cm$^2$, abs) |
| Temperature | 410K (137° C.) |
| Flow rate | 0~3.7% (turbine inlet flow rate ratio $\beta$) |

Figure 7:
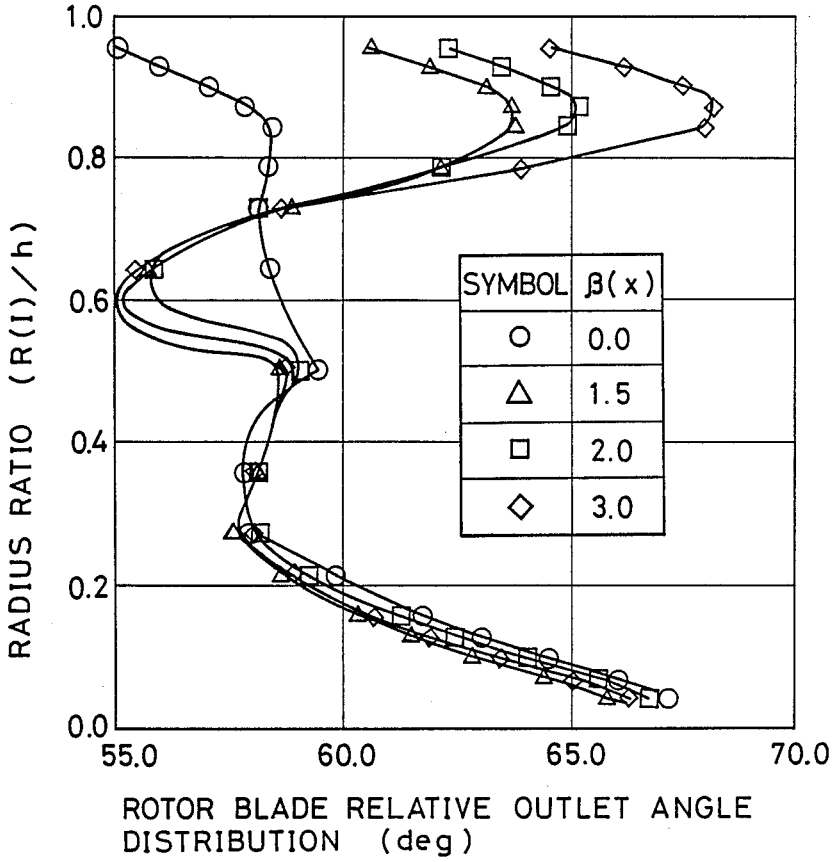
FIG. 7 is a graph showing the relative outlet angle distribution of the rotor blades.

The results of the experiment are shown in the graph of FIG. 7, which illustrates the relative outlet angle distribution of the rotor blades. The graph clearly shows that by raising the ratio of the flow rate of the secondary fluid, which is discharged from the blow holes 10, to the flow rate of the primary or main fluid at the turbine inlet from 1.5% to 3.0% at the ends of the rotor blades, the relative outlet angle of the rotor blades is increased and work is performed at the blade ends. In other works, it may be understood from the graph that the leakage of primary fluid from the rotor blade ends is minimized.

It should be noted that these effects are obtained through a simple structure which is easy to fabricate since the casing 8' at the rotor blade ends need only be provided with the blow holes 10 that form the fluid flow countering the leakage flow of primary fluid.

As many apparently widely different embodiments of the present invention can be made without departing from the spirit and scope thereof, it is to be understood that the invention is not limited to the specific embodiments thereof except as defined in the appended claims.

What we claim is:

1. A turbomachine comprising:

a casing forming a fluid passage through which a primary fluid flows;

rotor blades disposed for rotation in the fluid passage with a clearance between distal ends of said rotor blades and said casing;

a secondary fluid chamber being provided radially outwardly of said casing; and said casing having a plurality of spaced blow holes extending circumferentially thereof for communicating the secondary fluid chamber with the clearance, said blow holes being formed at an incline with respect to the wall of said casing in such a manner that a secondary fluid discharged from said blow holes is imparted with a flow component that opposes a direction of rotation of the blades and a flow of the primary fluid leaking from the clearance.

2. The turbomachine according to claim 1, wherein said blow holes are inclined at an angle of 30° with respect to the wall of said casing, said blow holes being arranged in a plurality of rows spaced axially of the machine.

3. The turbomachine according to claim 2, wherein the blow holes in each of said rows have diameters different from the blow holes in the other of said rows.

* * * * *